US005113636A

United States Patent [19]

Mihara et al.

[11] Patent Number: 5,113,636

[45] Date of Patent: May 19, 1992

[54] CAN LID FEEDER

[75] Inventors: Hirokata Mihara, Tokyo; Koichi Takagi; Teruo Shimizu, both of Nagoya; Katsunori Tashiro; Hideo Takahashi, both of Sunto, all of Japan

[73] Assignee: Mitsubishi Jukogyo Kabushiki Kaisha, Tokyo, Japan

[21] Appl. No.: 645,341

[22] Filed: Jan. 23, 1991

Related U.S. Application Data

[63] Continuation of Ser. No. 291,790, Dec. 29, 1988, abandoned.

[30] Foreign Application Priority Data

Dec. 29, 1987 [JP] Japan ..... 62-334108
Mar. 25, 1988 [JP] Japan ..... 63-39326[U]
Mar. 28, 1988 [JP] Japan ..... 63-73658

[51] Int. Cl.[5] ..... B65B 7/28; B65H 3/32

[52] U.S. Cl. ..... 53/308; 53/309; 271/113; 271/117; 271/119; 271/121; 221/222; 221/242; 221/289; 413/50

[58] Field of Search ..... 271/113, 117, 118, 119, 271/121; 221/222, 242, 289, 35, 37; 413/45, 47-52; 53/308, 309

[56] References Cited

U.S. PATENT DOCUMENTS

| | | | |
|---|---|---|---|
| 2,469,401 | 5/1949 | Nordquist | 413/45 |
| 2,640,452 | 6/1953 | Stone | 413/52 |
| 2,746,413 | 5/1956 | Peterson, Jr. | 413/52 |
| 2,750,913 | 6/1956 | Pechy | 413/52 |
| 2,840,963 | 7/1958 | Osmond | 221/222 |
| 3,119,519 | 1/1964 | Carpenter | 221/222 |
| 3,426,941 | 2/1969 | Hovekamp | 221/222 |
| 3,455,484 | 7/1969 | Edwards | 221/222 |
| 3,712,483 | 1/1973 | Messervey | 221/222 |
| 3,938,675 | 2/1976 | Rees | 53/308 |
| 3,958,720 | 5/1976 | Anderson | 221/241 |

*Primary Examiner*—James G. Smith
*Assistant Examiner*—Jack Lavinder
*Attorney, Agent, or Firm*—Wenderoth, Lind & Ponack

[57] ABSTRACT

A can lid feeder, for use with a can seamer, has a separator for can lids which projects into a drop hole provided in a cylindrical body at the bottom of a hopper and which separates dropped and stacked can lids one by one from the bottom of the stack. A rotary shaft of the separator extends in a gear box which is supported in the feeder in a freely swingable manner. The gear box is swingable so that the separator can move in the radial direction with respect to the cylindrical body having the drop hole. After a side surface of the swinging gear box has been brought into contact with the outer circumferential surface of the cylindrical body, the gear box is fixed in position by a clamp lever. According to another apsect of the present invention, the separator for can lids is of a rotary type and is provided with the independent screw grooves in its circumferential surface for separating can lids one by one from the bottom of a stack of can lids which have dropped through a drop at the bottom of a hopper and have become stacked. According to still another aspect of the invention a can lid feeding mechanism for successively feeding can lids to cans filed with liquid is disposed midway of a can feeding conveyor between a filler and a can seamer.

4 Claims, 7 Drawing Sheets

10
2
14
18
19
20
7
34
26
26
23
11
11'
16
17
15
3
2

CAN LID FEEDER

This application is a continuation of now abandoned U.S. application Ser. No. 07/291,790 filed on Dec. 29, 1988 now abandoned.

BACKGROUND OF THE INVENTION

1. Field of the Invention

The present invention relates to a can lid feeder that is applicable for use with a can seamer for making aluminum cans, iron cans or the like to be filled with beer, coffee, juice, etc.

2. Description of the Prior Art

A separator/feeder for can lids has been heretofore proposed, for instance, in Laid-Open Japanese Patent Specification No. 56-139242 (1981). In this separator/-feeder shown in FIG. 11, a separator 1 is rotatably driven by a rotary shaft 8 that is in turn driven via a gear train 6 off of a drive shaft 5 of a can drum turret 4. Can lids 7 drop through a drop hole at the bottom of a hopper and are stacked in an inclined state with one edge of the stack placed on the top of a screw groove 9 of the separator 1. As the separator 1 rotates, one can lid at the bottom of the stack is lowered as guided by the screw groove 9 of the separator 1 to be fed whereby the next step of a process is carried out.

In addition, various kinds of can lid feeders for use with a can seamer have been heretofore proposed. In one example of such proposed can lid feeders shown in FIG. 13, cans 102 filled with liquid in a filler 101 are fed into a seaming turret 104 as conveyed by a can feed conveyor 103. Reference numeral 105 designates a can lid feeding turret disposed contiguously to the seaming turret 104. On the outer circumference thereof are formed guide grooves 105*a* similar to the guide grooves 104*a* for the cans 102 provided on the outer circumference of the seaming turret 104. Can lids 107 are made to fall onto the guide grooves 105*a* from a can lid feeding mechanism 106 disposed above turret 105, and a lid 107 which has been made to fall is fed onto a can 102 which has been conveyed by the can feed conveyor 103 and is about to be fed to the seaming turret 104. Thereafter, the can 102 and the lid 107 sent into the seaming turret 104 are subjected to a seaming operation by means of seaming rolls disposed around the seaming turret 104 (not shown). Thus, a completed packaging can 102' is sent through an outlet turret 108 whereby the next step of the process is carried out.

In the heretofore known can lid separator/feeder shown in FIG. 11, the separator 1 was fixed in position so as to be rotated about the axis of the rotary shaft 8. Accordingly, if the diameter of the can lid 7 was changed, it was necessary to always match the outer diameter of the separator 1 with the outer circumference of the can lid 7, and hence the separator had to be replaced by another separator matched with the new can lid. However, since the above-mentioned separator 1 could not be moved in the radial direction, the entire drive mechanism, that is, a gear train 6, a rotary shaft 8 and the like mounted with a separator matched with the changed can lid diameter had to be replaced. Therefore, there were shortcomings in that not only did numerous ones of the aforementioned drive mechanisms have to be prepared but also the exchanging thereof necessitated a long time.

In addition, the separator 1 in the above-described heretofore known can lid separator/feeder was provided with only one screw groove 9 as shown in FIG. 12. Accordingly, in the even that cans were conveyed at a high speed by a can feed conveyor traveling at a high speed, in accordance with the can feeding speed it was necessary to also feed the can lids at a high speed. As the separator 1 could separate and feed only one can lid during its one revolution, it was necessary to also rotate the separator 1 at a high rotational speed in accordance with the speed of the conveyor along which the cans filled with liquid were traveling. During this process, since the can lid was moved downwards with its one end engaged with the screw groove 9 as shown in FIG. 11, in the event that the separator 1 was rotated at a high speed, the extent of abrasion of the can lid was large and the side of the separator was also furiously abraded.

Further, in the apparatus shown in FIG. 11, since the cans 102 filled with liquid by the filler 1 and being conveyed by the can feed conveyor 103 did not yet have can lids placed thereon and, moreover, since the cans 102 were being conveyed at a considerably high speed, liquid would spill from the cans on the can feed conveyor 103, especially at the inlet of the seaming turret 104 where the can lid 107 was about to be fed, due to the fact that the can 102 began to rotate as a result of the transfer thereof onto a lifter (not shown) under a condition in which the can lid 107 had not yet been perfectly put on the can 102.

SUMMARY OF THE INVENTION

It is therefore one object of the present invention to provide an improved can lid feeder, for use with a can seamer, having a separator for separating and feeding can lids one by one from the bottom of a stack of can lids, in which the separator can be easily moved in the radial direction with respect to the center axis of the stack of can lids when the diameter of the can lids and the size of the packaging cans are changed.

Another object of the present invention is to provide an improved can lid separator in a can lid feeder, which is free from the above-mentioned shortcoming of the can lid separator in the prior art of having only one screw groove that results in the edges of the can lids as well as the screw groove of the can lid separator being furiously abraded when the separator is operated at a high rotational speed.

Still another object of the present invention is to provide an improved can lid feeder in a can seamer, which can inhibit the spilling of liquid from the cans, especially at the inlet of the seaming turret.

According to one feature of the present invention, there is provided a can lid feeder, for use with a can seamer, having a separator which projects into a drop hole provided in a cylindrical body at the bottom of a hopper in the can lid feeder and which separates dropped and stacked can lids one by one from the bottom of the stack. A rotary shaft of the separator extends in a gear box that is supported in the feeder in a freely swingable manner. The gear box is swingable so that the separator can move in the radial direction with respect to the cylindrical body having the drop hole. And, after a side surface of the swinging gear box has been brought into contact with the outer circumferential surface of the cylindrical body, the swinging gear box is fixed in position by means of a clamp lever.

According to another feature of the present invention, there is provided a can lid separator in a can lid feeder having a rotary separator provided with two screw grooves for separating can lids, that have dropped through a drop hole at the bottom of a hopper in the can lid feeder and have become stacked, one by one from the bottom of the stack.

According to still another feature of the present invention, there is provided a can lid feeder, for use with a can seamer, in which cans filled with liquid by a filler are sent to a seaming turret of the seamer via a can feed conveyor, and a can lid feeding mechanism for feeding can lids to cans filled with liquid is disposed midway of the can feed conveyor between the filler and the seamer.

According to the present invention as first described above, in the case where the cylindrical body at the bottom of the hopper is to be replaced for accommodating for a change in the can lid diameter, the clamp lever is released, and then the swinging gear box is swung about the center axis of the gear shaft, as guided along an elongated hole in the direction of the separator, away from the cylindrical body. After the cylindrical body has been replaced, a side surface of the swinging gear box is brought into contact with the outer circumferential surface of the cylindrical body. Under this condition the gear box is fixed in position by means of the clamp lever, whereby the separator is brought into a state in which it projects into the drop hole of the cylindrical body by a proper amount and the continuous feeding of the can lids having the new size becomes possible.

According to the present invention as secondly described above, when a can drum guide star wheel rotates, the can lid separator is rotated simultaneously via a gear train. This separator projects into a drop hole, into which can lids have dropped and have been stacked, from a bottom side thereof. The circumferential edge of the can lid at the bottom of the stack rides on the top of a first screw groove of the separator. Then, as the separator rotates, the can lids are sequentially lowered and fed into grooves of rails. When the separator has rotated half of a revolution, the next can lid begins to be lowered by the second screw groove and is fed into the grooves of the rails in succession to the first can lid.

According to the present invention as thirdly described above, cans filled with liquid by the filler and conveyed at a high speed along the can feed conveyor towards the seamer reach the can lid feeding mechanism. In this can lid feeding mechanism, the can lids being sent continuously as held by the guide grooves of the rails above the can drum guide star wheel are placed on the openings of the cans having been conveyed along the can feed conveyor and engaged with the can drum guide star wheel. The cans having the lids placed thereon are further conveyed along the can feed conveyor. At the terminal point of the conveyor, the cans are transferred to the seaming turret of the seamer, and on this seaming turret a seaming operation is effected by means of seaming rolls.

Owing to the above-mentioned structure and operation of the can lid feeder according to the present invention, the cylindrical body can be easily replaced to accommodate for a change in the can lid diameter by releasing the clamp lever and swinging the gear box away from the cylindrical body. After the replacement of the cylindrical body is carried out, under the condition where the side surface of the gear box has been brought into contact with the outer circumferential surface of the cylindrical body, the same gear box can be fixed in position by means of the clamp lever. Thus, since the amount of projection of the separator into the can lid drop hole can always be constant by merely bringing the side surface of the swinging gear box into contact with the outer circumferential surface of the cylindrical body, as compared to the case of replacing the whole drive gear mechanism including the separator as is required in the prior art apparatus, a position-setting of the separator is extremely accurate and simple. Moreover, the replacement work can be finished within a very short time. Thus, the advantage of the invention is very remarkable.

Furthermore, according to the present invention, owing to the fact that there are two screw grooves in the separator, in the case where the traveling speed of the cans filled with liquid as conveyed along the can feed conveyor is the same as that in the prior art, the rotational speed of the separator could be ½ that of the separator having one screw groove in the prior art. Accordingly, the problems of the can lids being abraded and scratched in the prior art apparatus can be mitigated. Also, the problem relating to abrasion and noise of the separator knife is not present, and advantages are provided in that the life of the separator can be prolonged.

In addition, according to the present invention, owing to the fact that the can lid feeding mechanism is disposed midway of the can feed conveyor between the filler and the seamer, when the can filled with liquid by the filler is fed to the seaming turret of the seamer, the can lid is already placed on the opening of the can. Hence, even if the can should rotate immediately after the can has been fed to the seaming turret, and prior to the completion of the seaming operation, the shortcoming of liquid spilling from the cans in the prior art apparatus in which the can lid was fed at the time when the can was fed to the seaming turret, is not present. Thus, the spilling of liquid from the can can be prevented almost perfectly, and therefore, the problem of cans containing an insufficient amount of liquid can be eliminated.

The above-mentioned and other objects, features and advantages of the present invention will become more apparent by referring to the following description of the preferred embodiments of the invention taken in conjunction with the accompanying drawings.

DETAILED DESCRIPTION OF THE PREFERRED EMBODIMENTS

Figure 2:
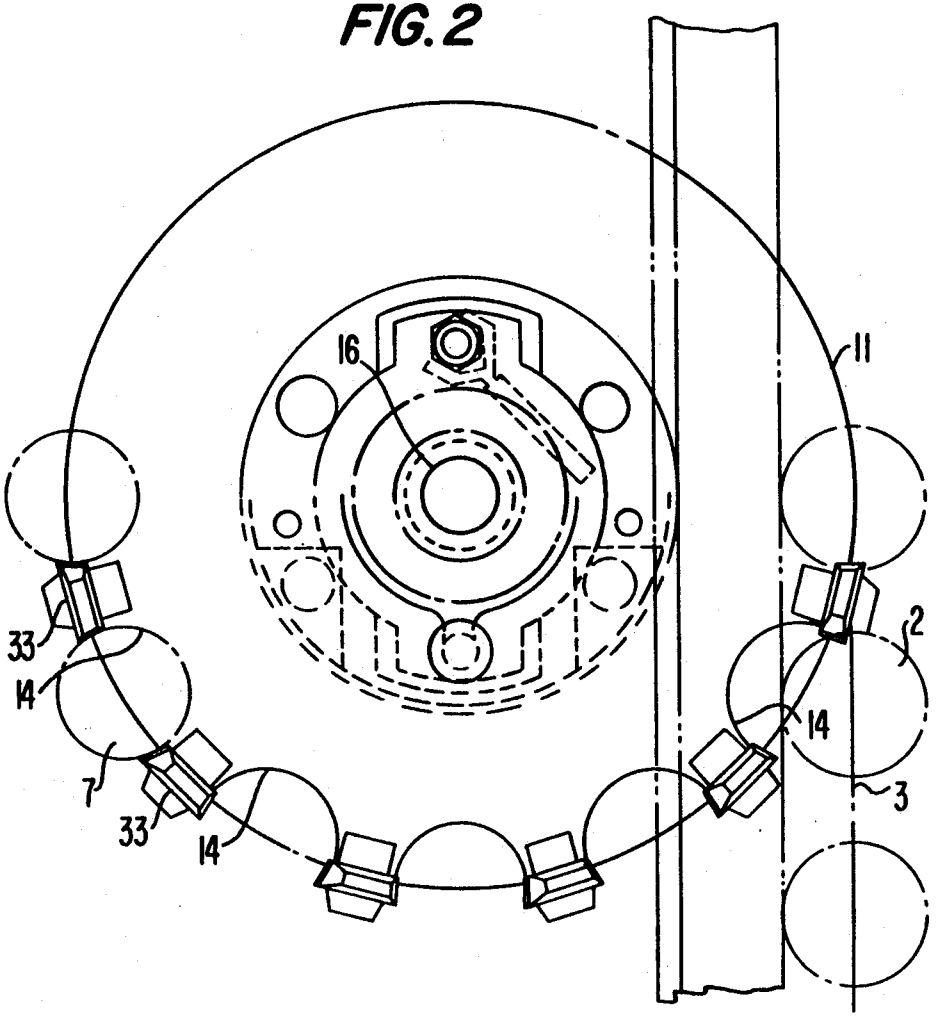
FIG. 2 is a plan view of a can drum guide wheel in the same feeder.
Figure 3:
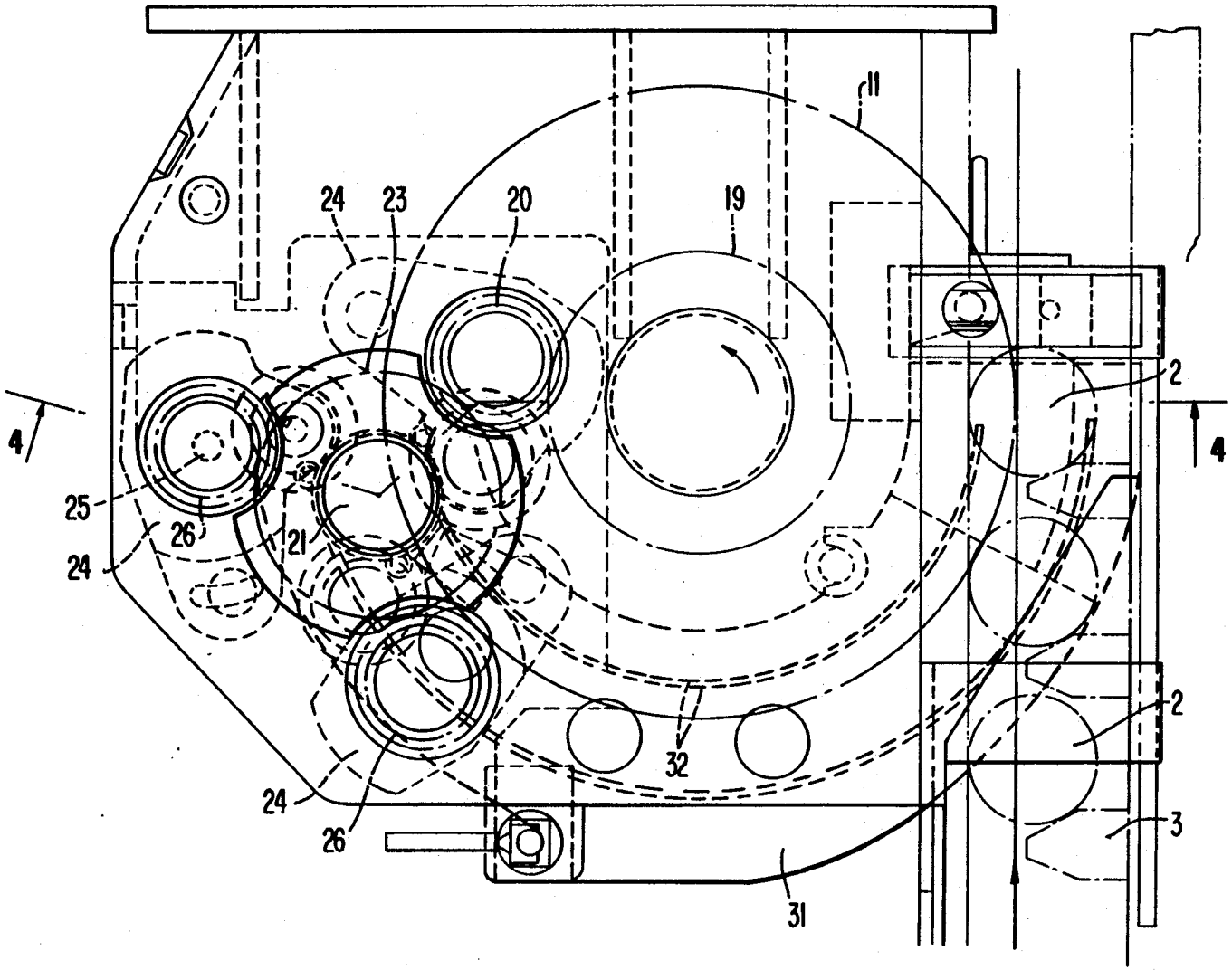
FIG. 3 is an enlarged plan view of the same.
Figure 4:
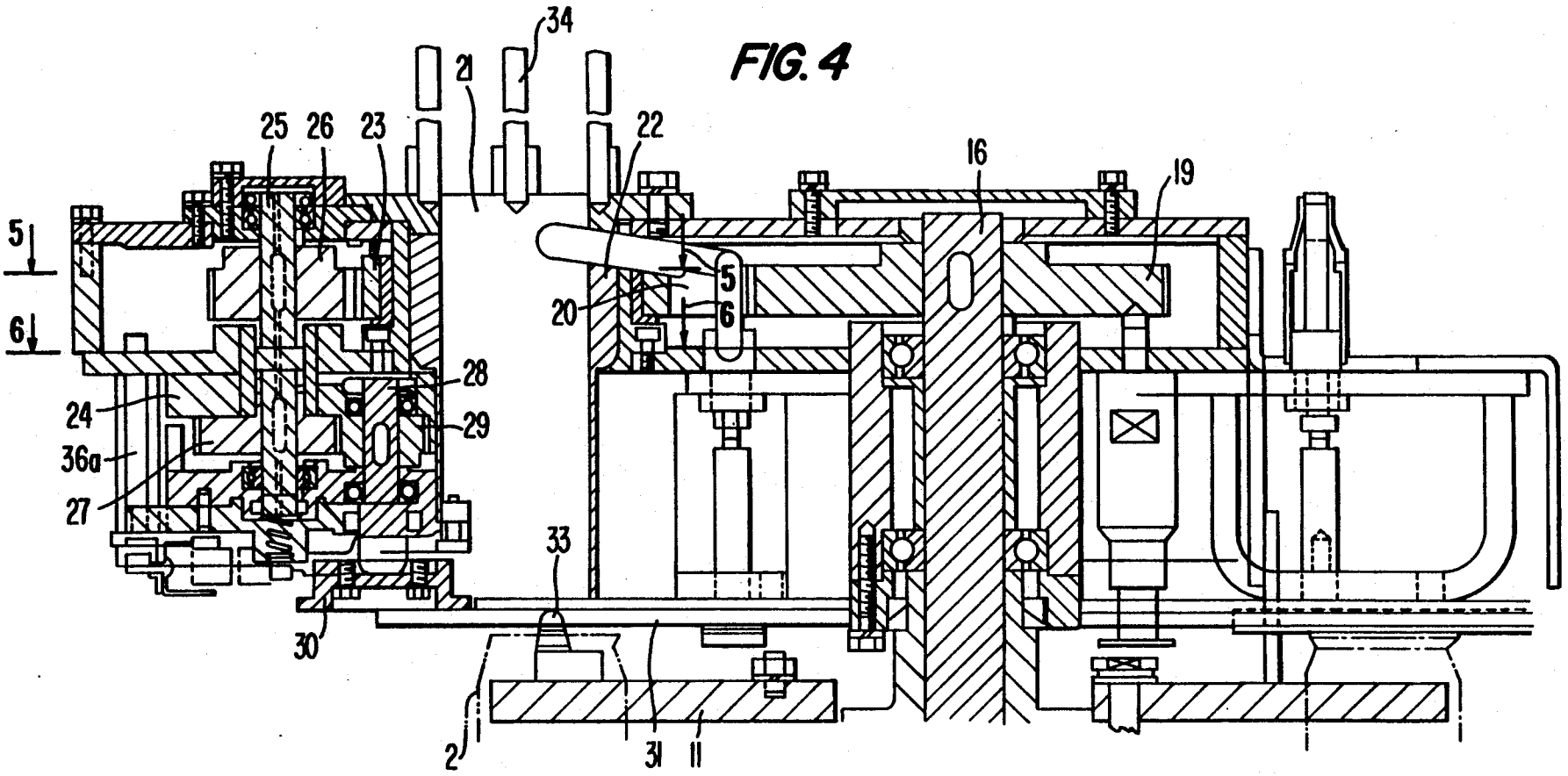
FIG. 4 is a cross-sectional view taken along line 4—4 in FIG. 2.
Figure 5:
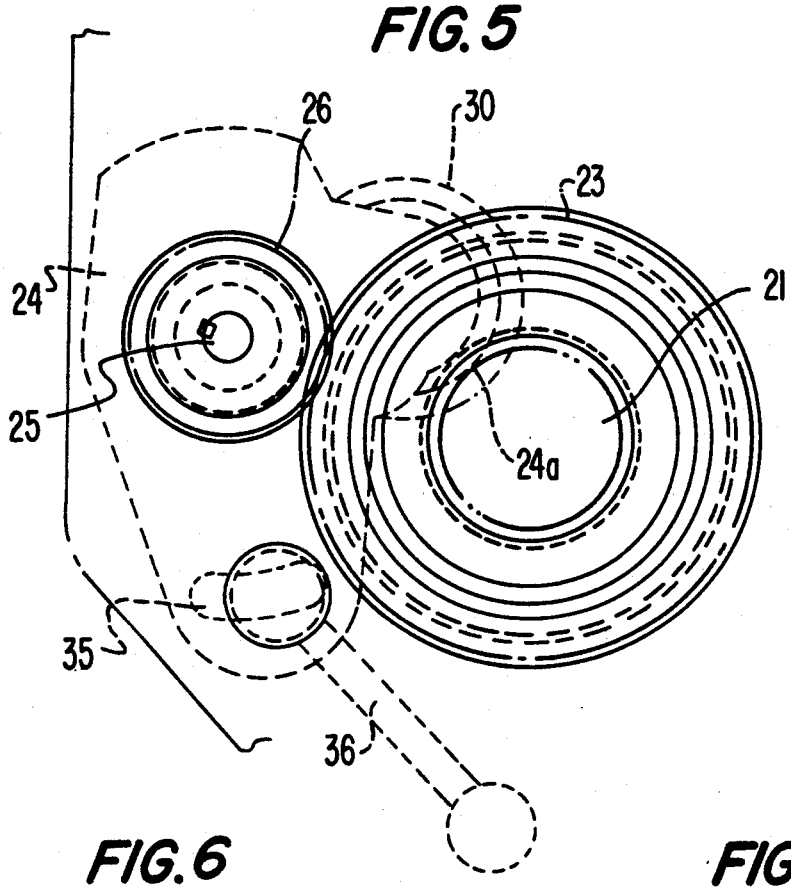
FIG. 5 is a cross-sectional view taken along line 5—5 in FIG. 4.
Figure 6:
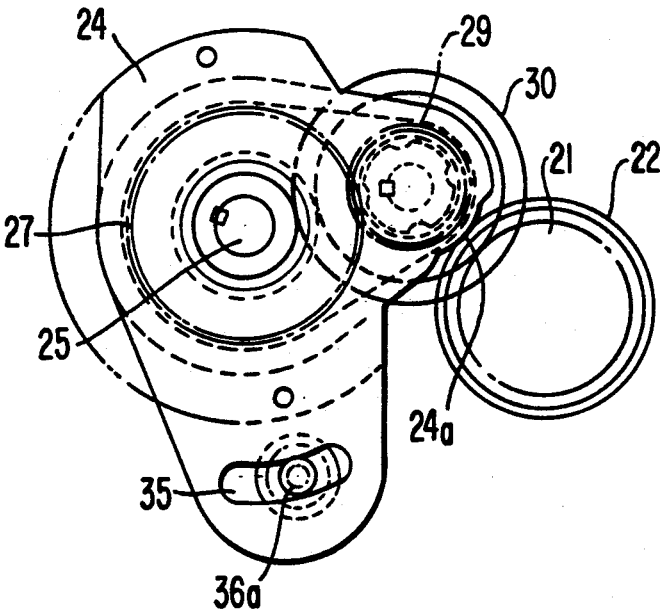
FIG. 6 is a cross-sectional view taken along line 6—6 in FIG. 4.
Figure 11:
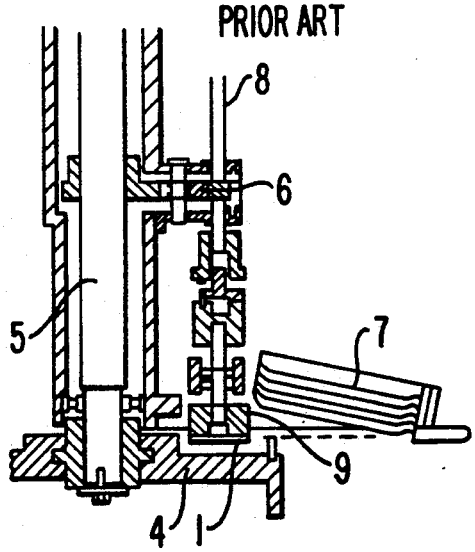
FIG. 11 PRIOR ART
FIG. 11 is a longitudinal cross-sectional view of one example of a can lid feeder in the prior art.

Now the present invention will be explained in connection with the illustrated embodiments. FIGS. 1 to 6 show a preferred embodiment of the present invention. First, with respect to a can lid feeder 10 illustrated in FIGS. 1 to 6, FIG. 1 is a perspective view showing only the general structure of the can lid feeder 10 in which a can drum guide wheel assembly is composed of a pair of upper and lower guide star wheels 11 and 11'. As shown in FIG. 2, these guide star wheels 11 and 11' have guide grooves 14, in which cans 2 conveyed along a can feed conveyor 3 would be engaged at a contact point between respective loci of their centers. Reference numeral 15 designates a drive gear, which is meshed with a gear 17 for driving a shaft 16 to which the can drum guide star wheels 11 and 11' are fixedly secured. Reference numeral 18 designates a rotary shaft which rotates in the direction of the arrow, and is provided for the purpose of synchronizing the can lid feeder 10 with a seamer (not shown). Reference numeral 19 designates a gear fixed to the top of the shaft 16. Gear 19 is adapted to rotate a gear 23, surrounding a cylindrical body 22 (FIG. 4) having a drop hole 21 therein, via an intermediate gear 20. The gear 23 is meshed with a gear 26 fixed to a shaft 25 which serves as a center of rotation of a swinging gear box 24. In addition, on the same shaft 25 is fixed a gear 27, which is in turn meshed with a gear 29 fixed on a shaft 28 that is rotatably supported in the swinging gear box 24. At the bottom of the same shaft 28 is fixedly secured a can lid separator 30. The can lid separator 30 serves to separate one can lid 7 at the bottom of a stack of can lids 7 which have dropped into the drop hole 21, and to feed it to grooves 32, 32 of a rail 31 (FIG. 3). Reference numeral 33 designates pushers mounted on the can drum guide star wheel 11 between the guide grooves 14, 14, which hold the can lids 7 fed between the grooves 32, 32 of the rail 31 right above the guide grooves 14 and convey them along the grooves 32, 32 of the same rail in accordance with the rotation of the can drum guide star wheel 11. Since the location where the can lid 7 is fed above the can 2, having been conveyed along the can feed conveyor 3 and in engagement with the can drum guide star wheels 11 and 11', is at the terminal ends of the grooves 32, 32, the can lid 7 is disengaged from the grooves 32, 32 and drops on the can 2 positioned just thereunder. Hence, the can 2 is sent to the seamer with the can lid 7 placed on the can opening, and a seaming operation is then effected.

The can lid separator 30 projects from a notched portion at the bottom of the cylindrical body 22 into the drop hole 21. The outer circumferential portion of the lowermost can lid is held at the top of a screw groove of the same separator 30, and as the separator 30 is rotated, the can lid is guided to the lower portion of the screw groove. However, when the can lid diameter is changed in accordance with a change in the can diameter, the separator 30 must be moved in the radial direction in view of the necessity for adapting it to the outer circumferential edge of the can lid. In addition, in the event that the can lid diameter has been changed, it is necessary to exchange the cylindrical body 22 with one having a drop hole diameter matched with the can lid diameter. However, regardless of whether the diameter of the new cylindrical body is larger or smaller than the previous one, the outer circumferential edge of the separator 30 can be projected into the drop hole 21 by a predetermined amount by merely bringing the side surface of the swinging gear box into contact with the outer circumferential surface of the cylindrical body 22. In this respect, gear box 24 would be swung about the shaft 25. The swinging gear box 24 is provided with an elongate hole 35 (FIGS. 5 and 6) that is arcuate about the axis of the shaft 25, and a positioning/clamping screw rod 36*a* associated with a clamp lever 36 is fitted in the elongate hole 35 to position the swinging gear box 24. If the positioning/clamping screw rod 36*a* is released by turning the clamp lever 36, the swinging gear box 24 can be manually made to swing arbitrarily as guided by the elongate hole 35 engaged with the screw rod 36*a*. Thereafter, if the screw rod 36*a* is fastened by turning the clamp lever 36 in the opposite direction, the swinging gear box 24 can be fixed in position.

Now the operation of the apparatus will be described. Cans 2 filled with liquid by a filler 1 are conveyed towards the can lid feeder 10 by the can feed conveyor 3..

Figure 1:
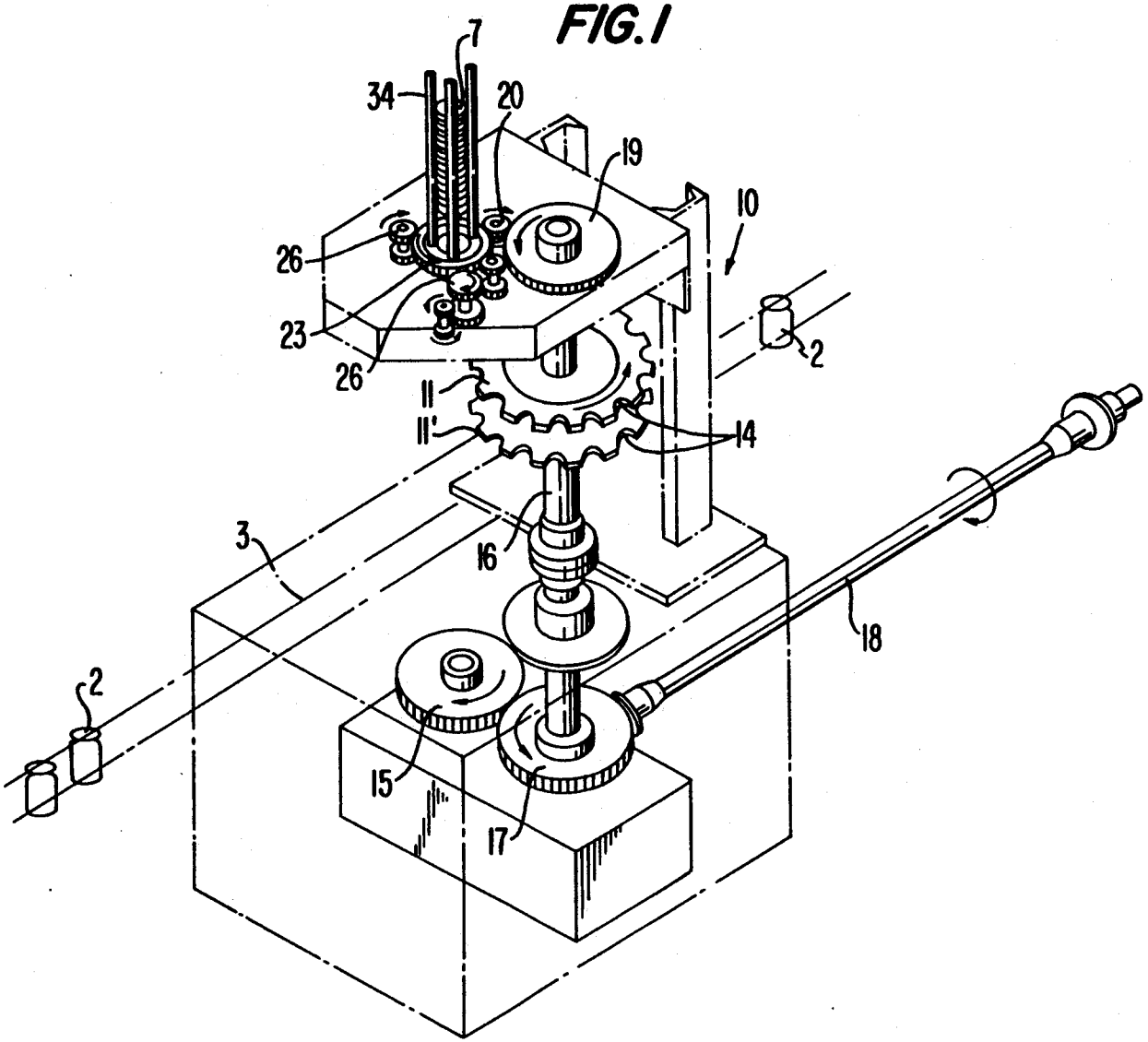
FIG. 1 is a perspective view of a can lid feeder according to a first aspect of the present invention.

On the other hand, the can drum guide star wheels 11 and 11' and the gear 19 are rotated via the gear 17 and the shaft 16 as driven by the drive gear 15 shown in FIG. 1. When the gear 19 rotates, the gears 20, 23 and 26 are rotated. Furthermore, the gears 27 and 29 are rotated via the shaft 25, thereby rotating the shaft 28 and the can lid separator 30.

Can lids 7 are fed from a hopper 34, then drop through the drop hole 21 of the cylindrical body 22 and are stacked. Then the lowermost can lid 7 is taken out as a result of the rotation of the can lid separator 30 and is fed into the grooves 32, 32 of the rail 31. The can lid 7 fitted in the grooves 32, 32 is pushed by the pusher 33 mounted on the can drum guide star wheel 11 under the rail 31. Hence, it is conveyed as held just above the guide groove 14 of the guide star wheel 11, and at the location where the grooves 32, 32 terminate, it drops towards the can opening from right above the can 2 that is disposed within the guide groove 14 of the can drum guide wheel 11 after having been conveyed by the can feed conveyor 3. Thus, the lid rests on the can over the opening thereof.

Subsequently, if the can diameter is changed, then the can lid diameter must also be changed. Thus, it is necessary to replace the cylindrical body 22 with a new one having a size matched with the changed can lid diameter. Prior to the replacement of the cylindrical body 22, the screw rod 36*a* is released by turning the clamp lever 36. Then, the gear box 24 is manually swung about the axis of the shaft 25, as guided by the elongate hole 35, to the position where the separator 30 is disengaged from the cylindrical body 22. Next, after the cylindrical body 22 has been replaced with the new one having a predetermined diameter, the gear box 24 is manually swung about the axis of the shaft 25 with the screw rod 36*a* of the clamp lever 36 guided along the elongate hole 35 to the position where a side surface 24*a* of the swinging gear box 24 comes into contact with the outer circumferential surface of the cylindrical body. Thereafter, when the clamp lever 36 is turned in the opposite direction, the positioning/clamping screw rod 36*a* is fastened. Thus, the swinging gear box 24 is again fixed in position by means of the clamp lever 36.

Figure 7:
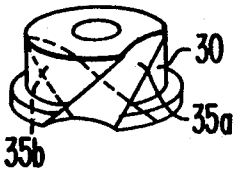
FIG. 7 is a perspective view of a can lid separator according to a second aspect of the present invention.
Figure 8:
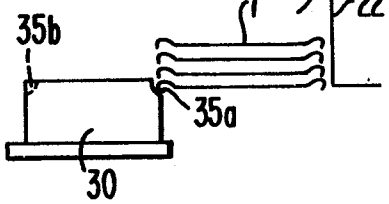
FIG. 8 is a schematic side view thereof showing an engaged condition between the separator and a can lid.
Figure 12:
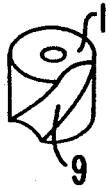
FIG. 12 (PRIOR ART)
FIG. 12 is a perspective view of the can lid separator in the prior art.

Now a second aspect of the present invention will be explained with reference to FIGS. 7 and 8. According to this aspect, the can lid separator 30 in the can lid feeder described above is improved as will be described below. In FIGS. 7 and 8, component parts equivalent to those in the first preferred embodiment shown in FIGS. 1 to 6 are designated by like reference numerals. As shown in FIG. 7, in the can lid separator 30 according to this modified embodiment, first and second screw grooves 35*a* and 35*b* are formed at symmetric positions so that the circumferential edge portion of the can lid 7 can be engaged with and held by separator 30 at the top portion of either screw groove 35*a* or 35*b*.

Explaining now the operation of this preferred embodiment, among the can lids 7 dropped through the drop hole 21 of the cylindrical body 22 and stacked, the circumferential edge portion of the lowermost can lid of the stack is engaged by separator 30 at the top of, for instance, the first screw groove 35*a* of the separator 30. As the can lid separator 30 rotates, the same can lid 7 is lowered by the first screw groove 35*a*. Subsequently, the second screw groove 35*b* receives the circumferential edge portion the can lid 7 that was second from the bottom, and so, the second can lid is also lowered similarly by the second screw groove 35*b*. And, in succession to the first can lid, the can lid 7 that was second from the bottom and is received in the second screw groove 35*b* is also fed into the grooves 32, 32 of the rail 31. The can lid 7 fitted in the grooves 32, 32 is pushed by the pusher 33 mounted on the can drum guide star wheel 11 under the rail 31, and is thus conveyed as held just above the guide groove 14 of the guide star wheel 11. At the location where the grooves 32, 32 terminate, the can lid drops towards the can opening from right above the can 2 that is engaged with the guide groove of the can drum guide star wheel 11 after having been conveyed by the can feed conveyor 3. Thus the can lid rests on the can over the opening thereof. It is to be noted that the grooves 32, 32 are inclined downwards towards a terminal end portion to reduce the drop distance over which each can lid drops on the can so that the can lid can drop accurately onto the can opening. The cans 2 having the can lid 7 placed on their openings in the above-described manner, are further conveyed by the can feed conveyor 3 to the seamer.

Figure 9:
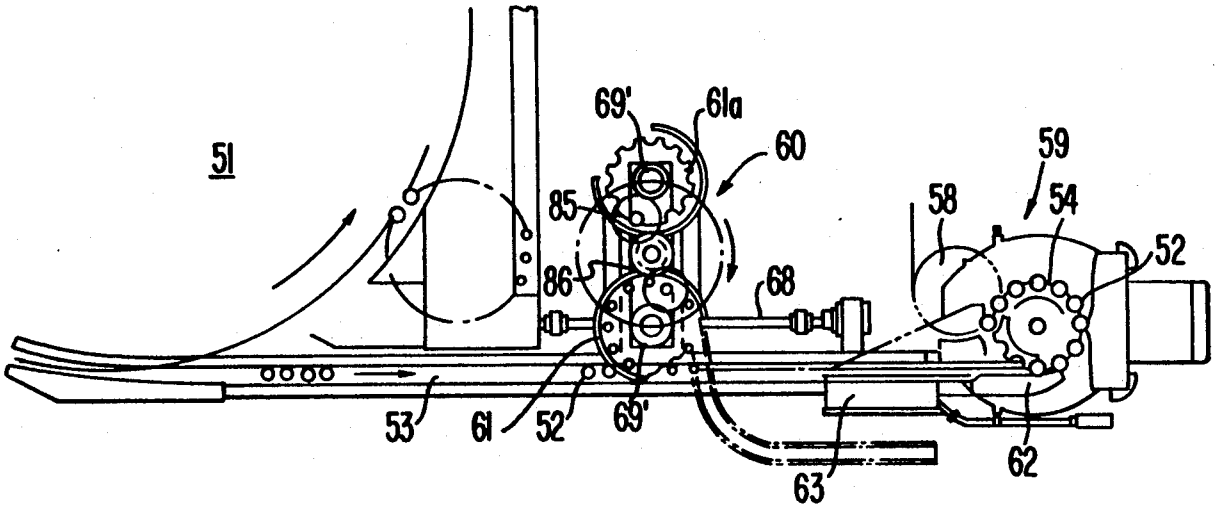
FIG. 9 is a plan view of a can making machine showing an installed position of a can lid feeder according to a third aspect of the present invention.
Figure 10:
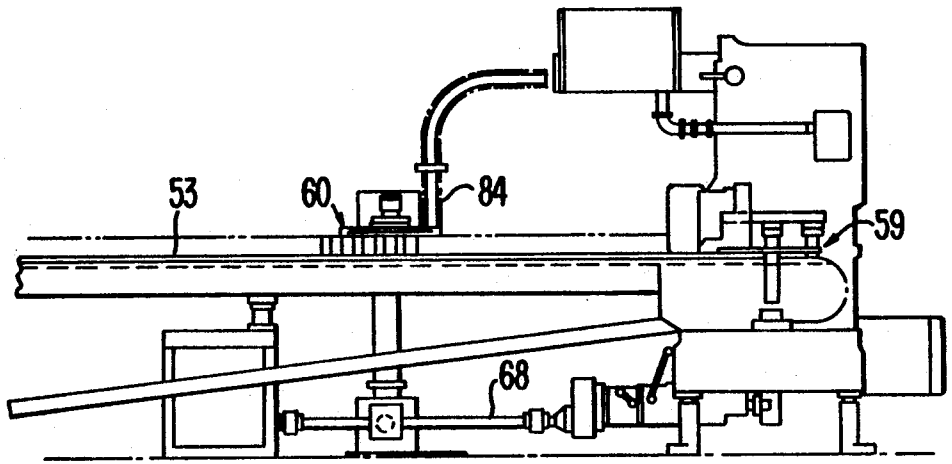
FIG. 10 is a side view of the same can making machine.
Figure 13:
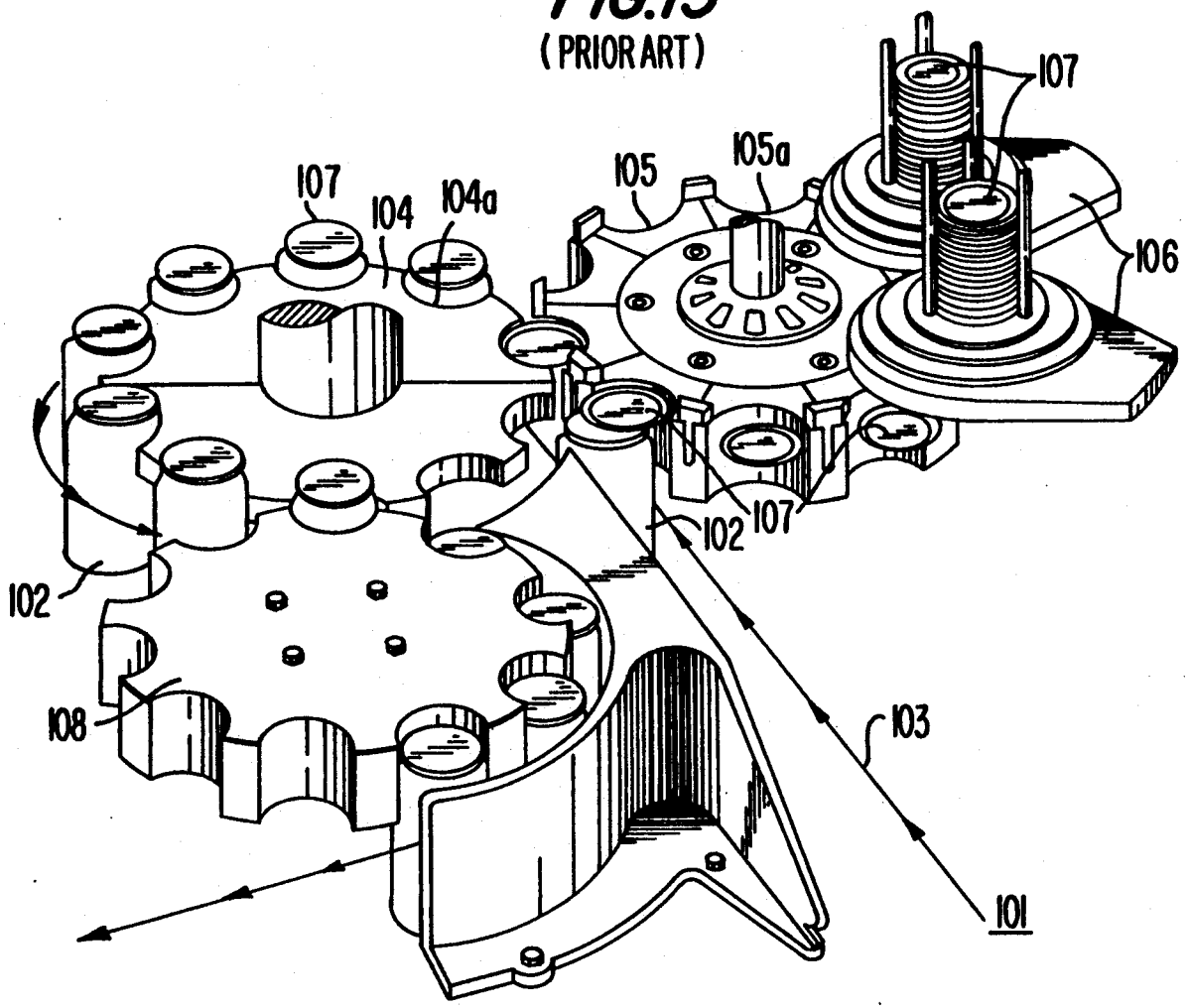
FIG. 13 (PRIOR ART)
FIG. 13 is a perspective view of a can lid feeder in the can seamer in the prior art showing the installed state thereof.

In the following, a third aspect of the present invention will be described with reference to FIGS. 9 and 10. In these figures, reference numeral 51 designates a filler, number 52 designates cans, numeral 53 designates a can feed conveyor, numeral 54 designates a seaming turret of a seamer 59, and numeral 58 designates an outlet turret known in the prior art as shown in FIG. 13. Reference numeral 60 designates a can lid feeder which forms as essential part of the present invention. As shown in FIG. 9 can drum guide star wheels are disposed at two locations 61 and 61*a* in a turret so as to be used alternately as facilitated by a switching operation. When the star wheel 61*a* is not being used, can lids having a different size to be used next are loaded or other preparations are effected. However, the can lid feeder according to the present invention could be provided with only one can drum guide star wheel 11 as described above (see FIG. 1). Reference numeral 62 in FIG. 9 designates an inlet guide.

It is to be noted that while the can lid feeder 60 is disposed midway of the can feed conveyor 53 between the filler 51 and the seamer 39 the can lid feeder 60 could be disposed on the frame 63 of the seamer 59. However, even in such a can lid feeder disposed on frame 63, the can lid feeder can still be disposed midway of the can feed conveyor 53 between the filler 51 and the seamer 59. As the can lid feeder 60, for example, a can lid feeder of the type according to the first aspect of the invention can be employed.

The cans 52 filled with liquid by the filler 51 are conveyed towards the can lid feeder 60 by means of the can feed conveyor 53. In the can lid feeder 60 as described previously with reference to FIGS. 1 to 6, can lids 7 are fed from the hopper 34, and drop through the drop hole 21 in the cylindrical body 22 to be stacked. The can lid 7 at the bottom of the stack is taken out by the rotating can lid separator 30, and is fed into the grooves 32, 32 of the rail 31. The can lid 7 fitted in the grooves 32, 32 is pushed by the pusher 33 mounted on the can drum guide star wheel 11 under the rail 31 so as to be conveyed as held right above the guide groove 14 of the same guide star wheel 11. And, at the location where the grooves 32, 32 terminate, the can lid drops towards the opening of the can 2 engaged with the guide groove 14 of the can drum guide star wheel 11 so as to rest on the can over the opening thereof. It is to be noted that the grooves 32 are inclined downwards whereby the distance over which the can lid drops onto the can is relatively small so that the can lid can drop accurately onto the can.

The can 52 having the can lid placed over the opening thereof in the above-described manner, is further conveyed by the can feed conveyor 53 towards the can seamer 59 so as to be fed to the seaming turret 54. Then the can and lid are subjected to a seaming operation by means of seaming rolls (not shown).

Since the can lid feeder according to the present invention has the structure described in detail above, the cylindrical body can be easily replaced, in accordance with a change in the can lid diameter, by releasing the clamp lever and swinging the gear box. After replacement of the cylindrical body, under the condition where the side surface of the swinging gear box has been brought into contact with the circumferential surface of the cylindrical body, the same gear box can be fixed in position by means of the clamp lever. Thus, since the amount of projection of the separator into the can lid drop hole can always be constant by merely bringing the side surface of the swinging gear box into contact with the circumferential surface of the cylindrical body, as compared to the case of replacing the whole gear drive mechanism including the separator as is required in the prior art apparatus, a position-setting of the separator is extremely accurate and simple. Moreover, the replacement work can be finished within a very short time. Thus, the advantage of the present invention is very remarkable.

Furthermore, in the can lid feeder according to the present invention, since there are two screw grooves in the separator, in the case where the traveling speed of the cans filled with liquid as conveyed along the can feed conveyor is the same as that in the prior art, the rotational speed of the separator could be ½ that of the separator having one screw groove in the prior art. Accordingly, the problems of the can lids being abraded and scratched in the prior art apparatus can be mitigated. Also, the problem relating to abrasion and noise of the separator knife is not present, and advantages are provided in that the life of the separator can be prolonged.

In addition, in the can lid feeder according to the present invention, since the can lid feeding mechanism is disposed midway of the can feed conveyor between the filler and the seamer, when the can filled with liquid is fed to the seaming turret of the seamer, the can lid is already on the can. Hence, even if the can should rotate immediately after the can has been fed to the seaming turret and prior to the completion of the seaming operation, the shortcoming of liquid spilling from the cans in the prior art apparatus in which the can lid was fed at the time when the can was fed to the seaming turret, is not present. Thus, the spilling of liquid from the can can be prevented almost perfectly, and therefore, the problem of cans containing an insufficient amount of liquid can be eliminated.

Since many changes and modifications in design can be made to the above-described invention without departing from the spirit thereof, it is intended that all matter contained in the above description and illustrated in the accompanying drawings shall be interpreted to be illustrative and not as limitative of the scope of the invention.

What is claimed is:

1. A can lid feeder for feeding can lids one at a time, said feeder comprising:

a cylindrical body defining a drop hole therein for accommodating a stack of can lids;

a gear box including a housing, a shaft rotatably supported in the housing, a separator fixed to said shaft and capable of separating stacked can lids one by one from the bottom of a stack of such lids when the separator is rotated, and meshing gears operatively connected to said shaft so as to rotate the shaft when the gears are driven;

mounting means for supporting said gear box in the feeder so as to be swingable, relative to said cylindrical body about a pivot axis of the gear box spaced from said shaft, between a first position at which said separator is disposed at a location adjacent the bottom of said drop hole while a side surface of the gear box contacts the outer circumferential surface of said cylindrical body and a second position at which said separator is disposed radially outward of said location with respect to said cylindrical body; and fixing means for releasably fixing said gear box relative to said cylindrical body, said fixing means including structure defining an arcuate elongate hole having a radius of curvature centered at the pivot axis of said gear box, a rod extending through said elongate hole and fixed to said gear box, and a clamp lever for releasably clamping said rod to said structure.

2. A machine for making canned goods, comprising:

a filler for filling can bodies with goods to be packaged therein;

a seaming turret, disposed downstream of said filler in the machine, for securing can lids to can bodies that have been filled by said filler;

a feed conveyor extending between said filler and said seaming turret for conveying can bodies filled by said filler toward said seaming turret; and a can lid feeder, disposed midway of said feed conveyor between said filler and said seaming turret, for placing can lids on can bodies over openings thereof after the can bodies have been filled by said filler and prior to said can bodies reaching said seaming turret, said can lid feeder comprising a cylindrical body defining a drop hole therein for accommodating a stack of can lids, a gear box including a housing, a shaft rotatably supported in the housing, a separator fixed to said shaft and capable of separating stacked can lids one by one from the bottom of a stack of such lids when the separator is rotated, and meshing gears operatively connected to the shaft so as to rotate said shaft when the gears are driven, mounting means for supporting said gear box in the feeder so as to be swingable, relative to said cylindrical body about a pivot axis of the gear box spaced from said shaft, between a first position at which said separator is disposed at a location adjacent the bottom of said drop hole while a side surface of the gear box contacts the outer circumferential surface of said cylindrical body and a second position at which said separator is disposed radially outward of said location with respect to said cylindrical body, and fixing means for releasably fixing said gear box relative to said cylindrical body said separator including a rotary body rotatably supported in the can lid feeder and positioned at one side of said cylindrical body adjacent the bottom of the drop hole defined therein, said rotary body having two spaced-apart thread-like grooves extending therein.

3. A machine for making canned goods as claimed in claim 2, wherein said fixing means includes structure defining an arcuate elongate hole having a radius of curvature centered at the pivot axis of said gear box, a rod extending through said elongate hole and fixed to said gear box, and a clamp lever for releasably clamping said rod to said structure.

4. A machine for making canned goods, comprising:

a filler for filling can bodies with goods to be packaged therein;

a seaming turret, disposed downstream of said filler in the machine, for securing can lids to can bodies that have been filled by said filler;

a feed conveyor extending between said filler and said seaming turret for conveying can bodies filled by said filler toward said seaming turret; and a can lid feeder, disposed midway of said feed conveyor between said filler and said seaming turret, for placing can lids on can bodies over openings thereof after the can bodies have been filled by said filler and prior to said can bodies reaching said seaming turret, said can lid feeder including turret, first and second can drum guide star wheels rotatably supported on the turret about respective axes of rotation spaced from one another, and means for rotating said turret between a first position at which said first star wheel is located alongside said feed conveyor with said second star wheel disposed away from said feed conveyor and a second position at which said second star wheel is located alongside said feed conveyor with said first star wheel disposed away from said feed conveyor.

* * * * *